US007598940B2

(12) United States Patent
Chou et al.

(10) Patent No.: US 7,598,940 B2
(45) Date of Patent: Oct. 6, 2009

(54) INVERTER FOR BOOSTING ROTATIONAL IMAGE DISPLAYING GAIN

(75) Inventors: Chin-Wen Chou, Taipei Hsien (TW); Ying-Nan Cheng, Taipei Hsien (TW); Ying-Chang Cheng, Taipei Hsien (TW); Chin-Biau Chung, Taipei Hsien (TW)

(73) Assignee: Zippy Technology Corp., Taipei Hsien (TW)

( * ) Notice: Subject to any disclaimer, the term of this patent is extended or adjusted under 35 U.S.C. 154(b) by 660 days.

(21) Appl. No.: 11/334,394

(22) Filed: Jan. 19, 2006

(65) Prior Publication Data

US 2007/0164977 A1 Jul. 19, 2007

(51) Int. Cl.
*G09G 3/36* (2006.01)

(52) U.S. Cl. ..... 345/102

(58) Field of Classification Search ..... 345/102, 345/47, 73, 74.1, 75.1; 315/224, 160, 169.3; 349/58

See application file for complete search history.

(56) References Cited

U.S. PATENT DOCUMENTS 6,791,239 B2 * 9/2004 Chou et al. ..... 310/318
2004/0227866 A1 * 11/2004 Okada ..... 349/58
2005/0068289 A1 * 3/2005 Diefenbaugh et al. ..... 345/102
2005/0093463 A1 * 5/2005 Jang et al. ..... 315/160
2005/0243052 A1 * 11/2005 Lim ..... 345/102

OTHER PUBLICATIONS

Sluyterman, Dynamic-Scanning Backlighting Makes LCD TV Come Alive, Journal of the Society for Information Display, Oct. 2005, cover, 28-31, ads 13-15, 21-10.

* cited by examiner

*Primary Examiner*—Regina Liang
*Assistant Examiner*—Shaheda A Abdin
(74) *Attorney, Agent, or Firm*—Muncy, Geissler, Olds & Lowe, PLLC

(57) ABSTRACT

An inverter for boosting rotational image displaying gain has a driving module to output a plurality of driving signals of the same frequency and same phase to synchronously drive a plurality of voltage transformation modules. The driving signals have a duty cycle consisting high luminance cycles and low luminance cycles. The driving module has a time sequence control means to code the driving signals that drive the voltage transformation modules as the high luminance cycles corresponding to the image display time of a front end display panel. The transformation time difference between the preceding image and the following image of the display panel is coded as the low luminance cycles. Thereby the rotational image displaying gain of the display panel can be enhanced.

6 Claims, 3 Drawing Sheets

INVERTER FOR BOOSTING ROTATIONAL IMAGE DISPLAYING GAIN

FIELD OF THE INVENTION

The present invention relates to an inverter for boosting rotational image displaying gain and particularly to an inverter that alters a light source illumination condition by controlling the driving mode of a voltage transformation module to boost rotational image displaying gain of a display panel.

BACKGROUND OF THE INVENTION

The power control technique for inverters is known in the art. For instance U.S. Pat. No. 6,791,239 discloses a technique to overcome problems encountered in a conventional inverter circuit. The conventional inverter circuit usually includes a pulse-width modulation (PWM) control unit, driving unit, and voltage boosting unit to drive individual charge lamp (CCFL or EEFL). With the size of display panels becomes bigger, the number of the discharge lamps required also increases. And the needed power also has to increase. To configure the PWM control unit, driving unit and voltage boosting unit according to the number of the discharge lamps not only has to increase the size of the circuit board, circuit configuration also is more difficult to do. Moreover, the discharge lamps tend to have luminance and electric field interference and result in non-uniform brightness. The patent mentioned above aims to provide an improvement that allows a single PWM control unit to synchronously output driving signals of the same phase and frequency according to the driving units and voltage boosting units required to drive the same number of discharge lamps at the rear end. Thereby each driving unit, voltage boosting unit and discharge lamp can be driven synchronously to achieve a uniform brightness.

INFORMATION DISPLAY October 2005 Vol. 21, No. 10, page 28 discloses a backlight technique "Dynamic-Scanning Backlighting Makes LCD TV Come Alive". Due to the display panel of the LCD transforms a liquid cell to a pixel in different electric fields, a transformation time difference occurs between a preceding image and a following image. This is also called rise-time or fall-time. The picture on the general LCD panel is updated at a frequency of 60 Hz, namely the picture has to be changed 60 times per second. Whether the preceding picture is altered on not, it has to be re-displayed at such a frequency. Hence each picture lasts 1/60=16.67 ms. If the rise-time is greater than this value, a blurred image occurs while the picture changes cyclically. To overcome this problem, the present design of the display panel focuses on reducing the rise-time to enhance the image quality of the display panel. But merely reducing the rise-time is not enough. As the actual transformation speed of gray scale is faster than the rise-time, hence if the light source is eliminated during the transformation of the gray scale, the rise-time can be confined only to transformation of black and white color scale. This can improve the picture quality of the display panel. The backlighting technique set forth above proposes a light source scanning technique which provides light only when the image is displayed, and the power of the backlight is turned off during the pixel rise-time so that not light is emitted. But in that technique the inverter of the backlight source has to be turned off at every duty cycle to stop delivering power. This is prone to damage the inverter, especially for the piezoelectric inverter driven by a high resonant frequency. The duty cycle is based on μs. If the width of controlling OFF cycle is too short, an instantaneous energy is generated according to the oscillation principle of the piezoelectric inverter. And an actual OFF condition cannot be achieved. On the other hand, if the width of controlling OFF cycle is too long, the piezoelectric inverter has to repeat oscillation from zero potential to a high potential to activate. The constant oscillation at high amplitude tends to damage the piezoelectric inverter. Hence while technique mentioned above could be adopted for a winding inverter to achieve a satisfactory result, it cannot be used effectively on the piezoelectric inverter.

SUMMARY OF THE INVENTION

The primary object of the present invention is to solve the aforesaid disadvantages. The present invention provides a control structure adaptable to various types of inverters to boost the rotational image displaying gain of display panels. The inverter of the invention has a driving module to output multiple sets of driving signals at the same frequency and same phase to synchronously drive multiple sets of voltage transformation modules. The driving signals have a duty cycle consisting of a high luminance cycle and a low luminance cycle. The driving module has a time sequence control means which codes the driving signals that drive the voltage transformation modules to become the high luminance cycle corresponding to the image displaying period of the front end display panel. And the transformation time difference between a preceding image and a following image is coded as the low luminance cycle. Thereby the rotational image displaying gain of the display panel can be enhanced.

The foregoing, as well as additional objects, features and advantages of the invention will be more readily apparent from the following detailed description, which proceeds with reference to the accompanying drawings.

DETAILED DESCRIPTION OF THE PREFERRED EMBODIMENT

Figure 1:
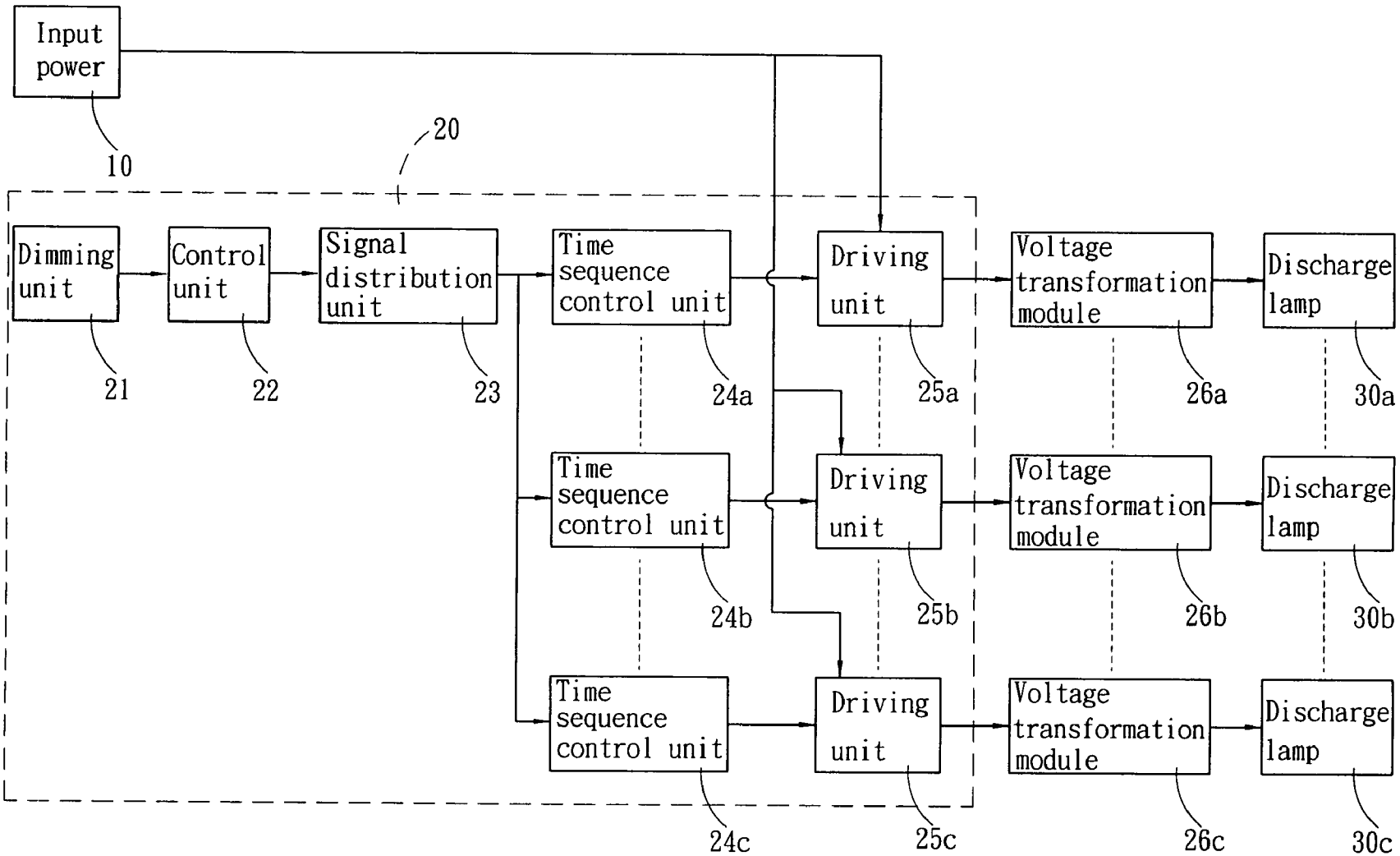
FIG. 1 is a circuit block diagram of an embodiment of the present invention.
Figure 2:
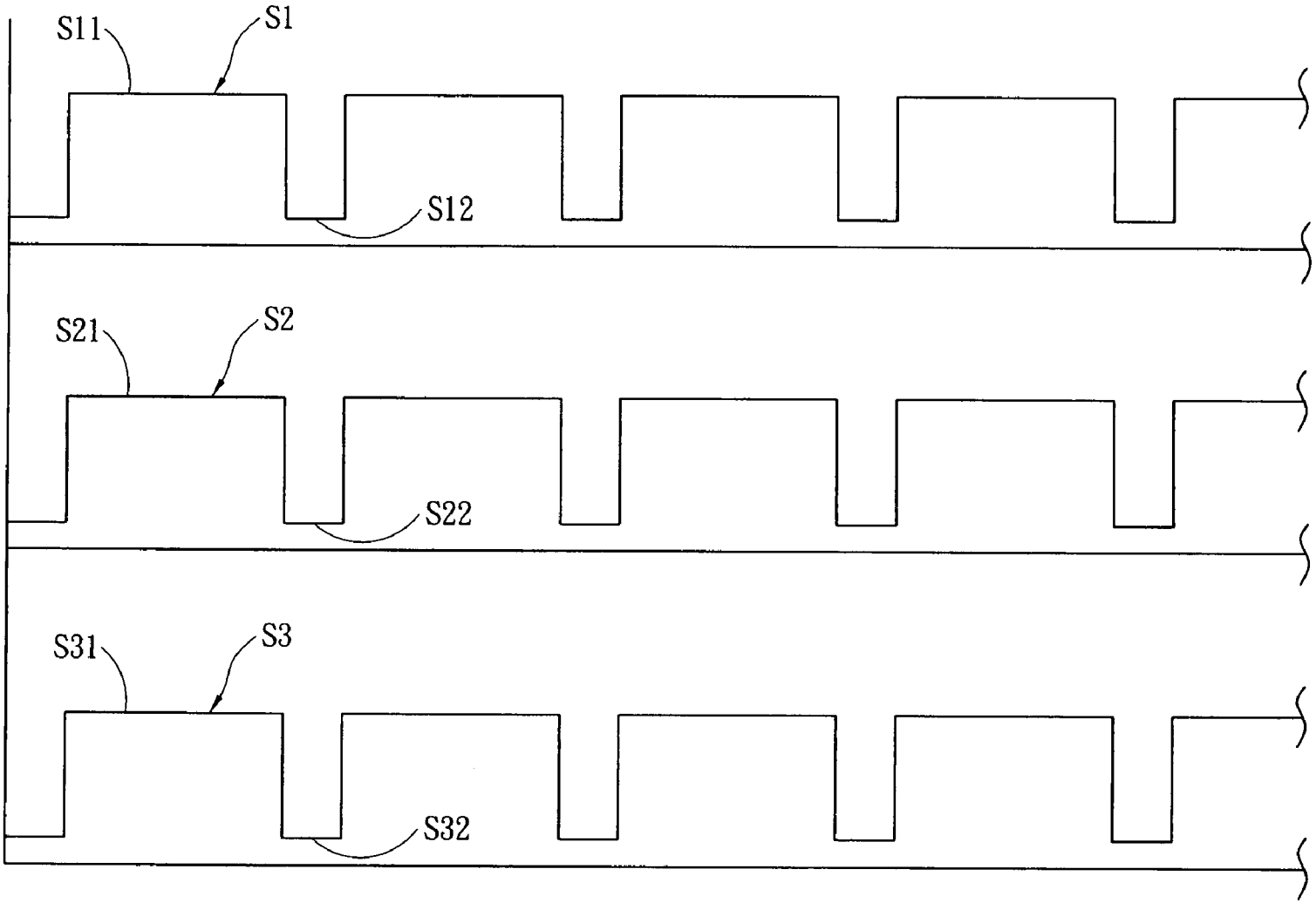
FIG. 2 is a schematic view of waveforms before the driving signals are sequentially coded.
Figure 3:
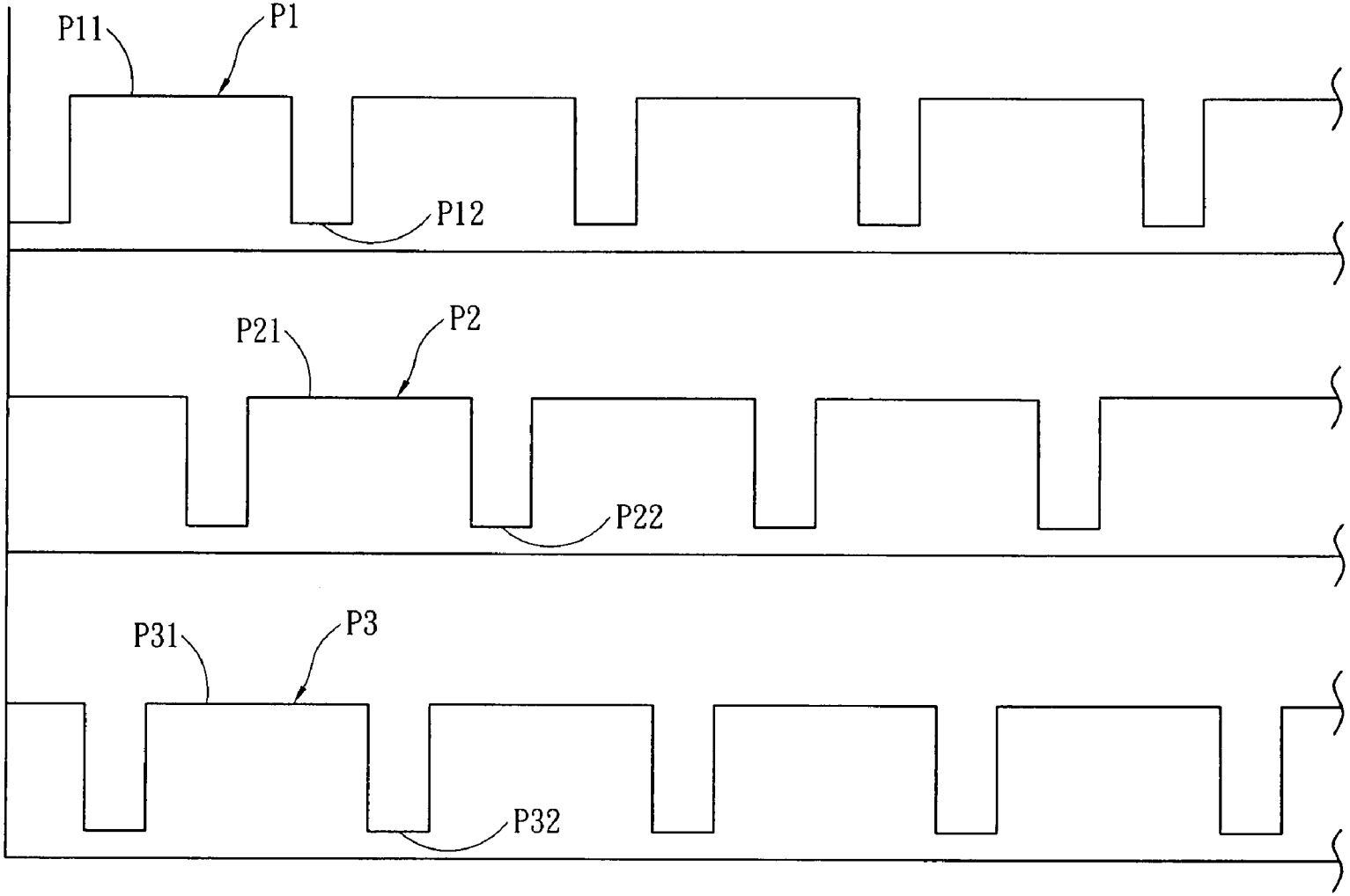
FIG. 3 is a schematic view of waveforms after the driving signals are sequentially coded.

Please referring to FIGS. 1, 2 and 3, the inverter for boosting rotational image displaying gain of the invention aims to control the driving mode of an inverter to change illumination conditions of charge lamps 30*a*-30*c* at a rear end. Such an inverter can be adopted for use on a display panel to boost the rotational image displaying gain. The inverter mainly includes a driving module 20 to output driving signals P1, P2 and P3 and a plurality of voltage transformation modules 26*a*-26*c* to receive the driving signals P1, P2 and P3 to transform an input power 10 to a high voltage output power to drive the charge lamps 30*a*-30*c* at the rear end. The driving signals P1, P2 and P3 of the driving module 20 have a same frequency and same phase to synchronously drive the voltage transformation modules 26*a*-26*c*. The driving module 20 can output a plurality of driving signals S1, S2 and S3 of a same frequency and phase through a control unit 22 (referring to U.S. Pat. No. 6,791,239 for technical details), or as shown in the drawings of the invention, the driving module 20 can output the driving signals S1, S2 and S3 through a control unit 22, and through a signal distribution unit 23 to output the driving signals S1, S2 and S3 of the same frequency corresponding to the voltage transformation modules 26*a*-26*c*. There is a dimming unit 21 at the front end of the driving module 20 to input luminance regulation signal. The rear end of the driving module has driving units 25*a*-25*c* to receive the driving signals S1, S2 and S3 and the input power 10. The driving signals S1, S2 and S3 have a duty cycle consisting of high luminance cycles S11, S21 and S31, and low luminance cycles S12, S22 and S32. The driving module 20 has a time sequence control means which consists of one or more time sequence control units 24*a*-24*c*. The time sequence control means codes the driving signals P1, P2 and P3 that drive the voltage transformation modules 26*a*-26*c* to become high luminance cycles P11, P21 and P31 corresponding to the image display time of the front end display panel. The transformation time difference between the preceding image and the following image of the display panel is coded as the low luminance cycles P12, P22 and P32.

Referring to FIG. 2, the driving signals S1, S2 and S3 are output through the signal distribution unit 23 corresponding to the voltage transformation modules 26*a*-26*c*. The driving signals S1, S2 and S3 corresponding to the transformation time difference of the preceding image and following image are defined as high luminance cycles S11, S21 and S31, and low luminance cycles S12, S22 and S32. The pulse wave composition number of the high luminance cycles S11, S21 and S31 and the low luminance cycles S12, S22 and S32 depends on the width of the transformation time difference. To mate the picture update frequency of the display panel, the driving signals S1, S2 and S3 have to be coded through the time sequence control units 24*a*-24*c*. The time sequence control units 24*a*-24*c* can add a delay time difference corresponding to the picture update frequency. Referring to FIG. 3, on the coded driving signals P1, P2 and P3, their high luminance cycles P11, P21 and P31, and low luminance cycles P12, P22 and P32 are generated sequentially by scanning same as the picture update frequency. It is to be noted that the high luminance cycles P11, P21 and P31, and low luminance cycles P12, P22 and P32 are duty signals. Hence the voltage transformation modules 26*a*-26*c* of the inverter continuously operates without interruption. As a result, the illumination of the light source is cyclic in a dim-bright-dim manner, namely it is different from the conventional light source illumination that is turned off cyclically in an OFF-ON-OFF manner. Moreover, the cyclic light source of the invention, by keeping the voltage transformation modules 26*a*-26*c* to operate continuously, can control the luminance of the light source more effectively. In addition, when the invention is adopted for a high frequency piezoelectric inverter, the problem of continuous excessive activating oscillation amplitude can be prevented. Hence the life span of the inverter can be maintained as desired.

While the preferred embodiment of the invention has been set forth for the purpose of disclosure, modifications of the disclosed embodiment of the invention as well as other embodiments thereof may occur to those skilled in the art. Accordingly, the appended claims are intended to cover all embodiments which do not depart from the spirit and scope of the invention.

What is claimed is:

1. An inverter, comprising:

a driving module to output a driving signal; and a plurality of voltage transformation modules to receive the driving signal and transform an input power to a high voltage output power to drive a discharge lamp connecting to a rear end;

wherein the driving signal of the driving module has a same frequency and a same phase to synchronously drive the voltage transformation modules, the driving signal having a duty cycle consisting of high luminance cycles and low luminance cycles, so that the voltage transformation modules operate continuously without interruption to drive the discharge lamp in a dim-bright-dim manner as a result of the duty cycle of high luminance cycles and low luminance cycles the driving module including a time sequence control means which codes the driving signal that drive the voltage transformation modules corresponding to image display time of a front end display panel, the display panel having a transformation time difference between a preceding image and a following image that is coded as the low luminance cycles.

2. The inverter of claim 1, wherein the driving module outputs the driving signal through a control unit, and through a signal distribution unit to output multiple sets of the driving signals of a same frequency corresponding to the voltage transformation modules, the signal distribution unit being connected to a time sequence control unit to assign sequence of the driving signals.

3. The inverter of claim 2, wherein the driving module has a dimming unit on a front end to input a luminance regulation signal and a driving unit at a rear end to receive the driving signal and the input power.

4. The inverter of claim 1, wherein the driving module outputs a plurality of driving signals of a same frequency and a same phase through a control unit, the control unit being connected to a time sequence control unit to assign sequence for the driving signals.

5. The inverter of claim 4, wherein the driving module has a dimming unit on a front end to input a luminance regulation signal and a driving unit at a rear end to receive the driving signals and the input power.

6. The inverter of claim 1, wherein a pulse wave composition number of the high luminance cycles and the low luminance cycles depends on the width of the transformation time difference.

* * * * *